United States Patent [19]

Lauzier

[11] 3,955,799

[45] May 11, 1976

[54] PROTECTIVE RAILING DEVICE

[75] Inventor: René Lauzier, Ruy, France

[73] Assignee: Cegedur GP, Paris, France

[22] Filed: Oct. 11, 1974

[21] Appl. No.: 514,273

Related U.S. Application Data

[63] Continuation of Ser. No. 220,033, Jan. 24, 1972, abandoned.

[30] Foreign Application Priority Data

Nov. 16, 1971 France ..... 71.40971

[52] U.S. Cl. ..... 256/21; 256/65; 256/59

[51] Int. Cl.[2] ..... B21F 27/00

[58] Field of Search ..... 256/21, 59, 22, 24, 256/65

[56] References Cited

UNITED STATES PATENTS 3,482,819 12/1969 Leurent ..... 256/21

3,485,006 12/1969 De Rozario ..... 256/65

FOREIGN PATENTS OR APPLICATIONS 104,100 6/1964 Norway ..... 256/59

*Primary Examiner*—Paul R. Gilliam
*Assistant Examiner*—Doris L. Troutman
*Attorney, Agent, or Firm*—McDougall, Hersh & Scott

[57] ABSTRACT

This invention is addressed to a new railing device formed of a pair of elongate rail elements having a base, a plurality of spaced openings in the base and a pair of ribs defining a bearing surface adjacent to the openings, and a plurality of support bars having a cross-section corresponding to the openings and a pair of grooves adjacent each end corresponding to the ribs adapted to elastically engage the ribs and the bearing surface to secure the bars in the rail elements and maintain the rail elements in a spaced parallel relation.

9 Claims, 3 Drawing Figures

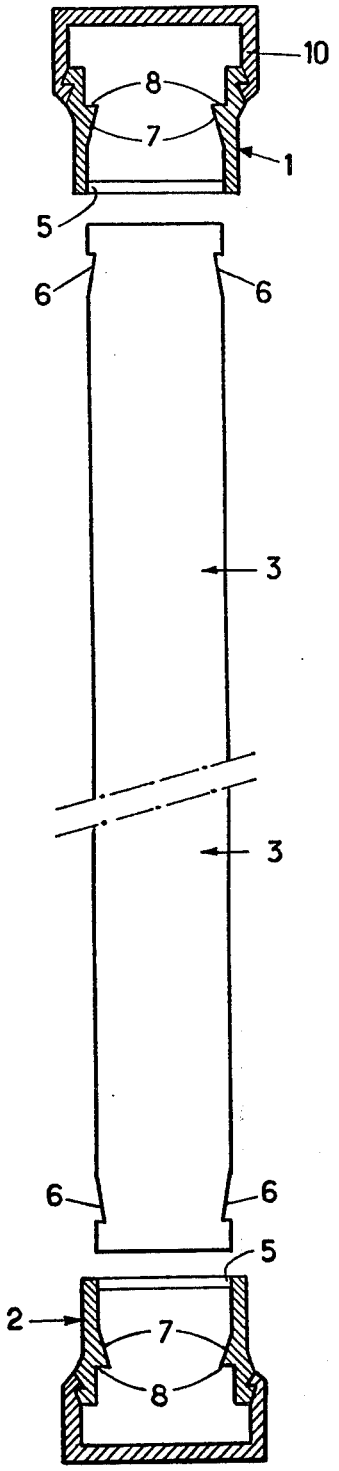
FIG. 2
FIG. 3
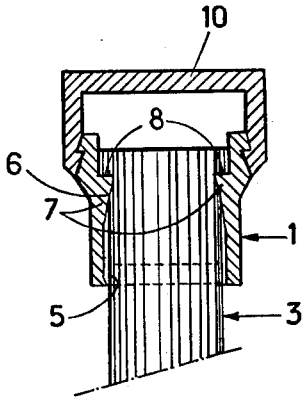

PROTECTIVE RAILING DEVICE

This is a continuation, of application No. 220,033, filed Jan. 24, 1972 now abandoned.

This invention relates to body protection or railing devices formed of a pair of profiles or rail elements having at least a U-shaped cross-section fixed to a plurality of bars.

In a variety of railing devices of the prior art, elongate railing elements are provided with spaced perforations or openings over the length thereof, and a plurality of support bars are adapted to be received in the openings and fixed therein by means of pegs, wires, screws, rivets and the like to form a unitary railing structure.

In an effort to avoid the use of fixing means of the type referred to above and thus reduce costs of labor and equipment, it has been proposed to make use of railing systems in which the members are assembled by elastic engagement.

The first supplement No. 93,886 to French patent No. 1,537,717 describes a body protection device composed of two open profiles, with the ends of the bars being fastened to the profiles by clipping. The bars are separated by interwedged members likewise fixed in the profiles by clipping and closing the profiles completely.

However, the use of interwedged members constitutes a serious disadvantage since it requires a third series of standardized parts in addition to the profiles and bars. Moreover, the variations in thickness of the bars and the variations in the length of the interwedged members may give rise to considerable irregularities which generally limit the length of the railing to 1.0 or 1.5 meter. Another disadvantage of such systems stems from the fact that the section of the bars must be rectangular so that considerable machining of the interwedged members can be avoided.

It is an object of the present invention to provide a railing device which overcomes the foregoing disadvantages, and it is a more specific object of the invention to provide a railing device in which the parts thereof can be assembled by clipping and yet is capable of assuming dependable and precise mounting with minimum labor.

These and other objects and advantages of the invention will appear more fully hereinafter and, for the purpose of illustration and not of limitation, an embodiment of the invention is shown in the accompanying drawings in which:

FIG. 2 is an elevation view in section of a railing device of the invention prior to assembly; and FIG. 3 is a detailed view of a support bar engaged with a rail element.

Figure 1:
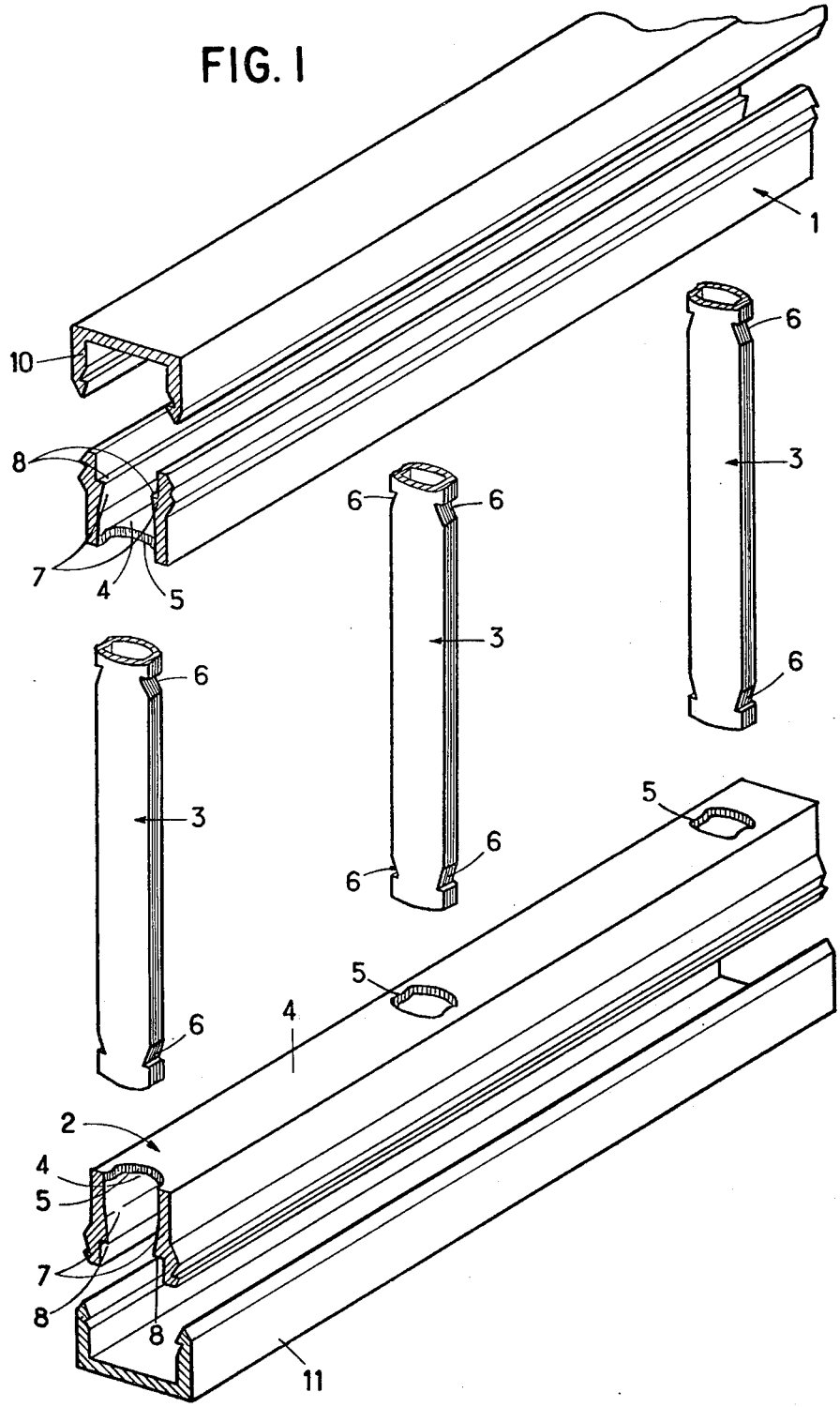
FIG. 1 is a partial, perspective, exploded view of a railing device embodying the features of the invention.

The concepts of the present invention reside in a railing or body protection device which is formed of a pair of elongate rail elements or profiles having substantially a U-shaped cross-section; maintained is a space relation by transverse support bars whose ends are sloped to enable the ends to elastically engage behind two supplementary ribs formed in each profile and defining a bearing surface. The bearing surfaces extend away from the respective profiles, with the base or core of the profiles being positioned opposite each other and having perforations or openings adapted to receive the bars for engagement with the bearing surfaces.

It has been found that the foregoing characteristics make it possible to eliminate the disadvantages of prior art systems while combining their advantages. The use of perforate core profiles avoids the addition of interwedged members to the system, but enables the system to be assembled by simply clipping the bars transverse to the railing elements or profiles. The use of separate fixation elements, such as screws, wires, etc., is completely avoided.

Referring now to the drawings for a more detailed description of the invention, there is shown a pair of profiles or rail elements 1 and 2 having a substantially U-shaped cross-section and a plurality of transverse support bars 3, preferably in the form of tubular bars. The parts are preferably manufactured by extrusion of aluminum, although it will be understood by those skilled in the art that use can also be made of foundry and particularly forged parts.

The base or core 4 of each profile is provided with a series of spaced perforations or openings 5 which correspond to the contours of the bars 3 to permit the passage of the bars 3 into the openings 5. As shown in FIGS. 1 and 2, the bases of rail elements 1 and 2 are positioned in opposing, but spaced face to face relation.

The ends of the bars 3 are formed with a pair of grooves 6 formed in the surfaces of the bars to permit elastic engagement behind ribs 7 formed in the rail elements 1 and 2. As shown in FIGS. 1 to 3, ribs 7 are formed on the opposing walls adjacent base 4 of each rail element and extend away from the base 4. The ribs 7 define a bearing surface 8 which is turned down, away from the base 4 of each profile, whereby the bearing surface 8 engages the corresponding grooves 6 on the bars 3 when the bars are inserted through the openings 5 in the base 4 of the rail elements. The assembly of the parts by elastic engagement or clipping can be rapidly accomplished with great simplicity as the ends of the bars serve to spread apart the ribs 7 prior to being blocked in the profiles.

Since the two rail elements can be arranged on a flat surface, it suffices to position the bars by simply placing them on, for example, a comb. The bars can then be put in place simultaneously on both of the rail elements with a press stroke. The result is a rail device formed of a pair of parallel rail elements 1 and 2 spaced from each other by means of the transverse bars 3 locked in position as desdribed above to define a unitary rail structure.

The perforations 5 in the base 4 of the rail elements can be easily formed in a conventional manner with, for example, a multiple punch press. The metal removed is in the neutral fiber and thus the solidarity of the rail elements is not affected.

The grooves 6 formed near the ends of the bars 3 can be conveniently formed by machining during the pipe cutting of the pipes from which the bars 3 can be obtained. This operation can be carried out with a simple and economical tool.

The bars 3 can have a variety of cross-sectional configurations; it is generally sufficient that the configuration of the perforations 5 correspond to the cross-section of the bars 3 to facilitate secure holding of the bars in the perforations. Any play between the bars and rail elements is therefore avoided, and stresses on the bars are not transmitted to the level of the clip, but to the periphery of the perforations which serves as a support.

If, as a result of too great a stress, a bar 3 is deformed, the clipping or locking on the bar continues to secure the bar because, since the stress is exerted on the bar in a downward direction, the bar continues to be secured by the bearing surface 8 of the upper rail 1.

If desired, the upper rail 1 can be provided with a standard handle 10 formed by a profile adapted to be clipped to the wings of rail element 1. Similarly, the lower rail element 2 can be closed by a profile 11 analogous to that of profile 10.

However, it will be understood by those skilled in the art that the invention is not restricted to rail elements formed with strictly a U-shaped cross-section. Different cross-sectional configurations, such as C-shaped configurations or even closed sections (e.g., an O-shaped cross-section) are also contemplated by the invention because the geometry of the rail elements is not critical. Thus, the term "U-shaped cross-section" as used herein should be interpreted in the broad sense.

The railing device of the invention not only has an aesthetic appearance, but is also characterized by remarkable solidarity, low cost of manufacture and ease of assembly.

It will be apparent that various changes and modifications can be made in the details of construction, assembly and use without departing from the spirit of the invention, especially as defined in the following claims.

I claim:

1. A railing device comprising a plurality of support bars having opposite side walls and a groove in each side wall spaced from the ends of the bars, said grooves having a portion in the direction of the adjacent end which extends inwardly substantially perpendicularly from the side wall and a contiguous portion which extends from the inner end of the groove outwardly to the side wall, and a pair of elongate rail members in spaced parallel relation having a base portion with a plurality of longitudinally spaced openings dimensioned to enable passage of the end portion of the bars therethrough, and side walls extending integrally substantially perpendicularly from the lateral edges of the base portion and spaced one from the other by an amount slightly greater than the width between the side walls of the bars with the side walls of one rail member extending in the direction away from the side walls of the other rail member so that the rail members define U-shaped members with oppositely facing concavities, the adjacent inner surfaces of the side walls, in at least the portions aligned with the openings, having a portion spaced from the base portion which tapers inwardly in the direction towards the opposite side wall to provide cam surfaces which terminate in a ridge which extends outwardly substantially perpendicularly to the side walls and which, at least at their terminal portions, are spaced one from the other in the adjacent side walls by an amount less than the width between the side walls of the bars whereby responsive to endwise displacement of the end portion of a bar through an opening in the base portion of the rail into the space between the side walls, the cam surfaces are engaged by the end portion of the bar to cause displacement of the side walls of the rail in the direction away from one another to increase the spaced relation therebetween until the grooves clear the terminal portions of the cam surfaces and enable return of the side walls thereby to establish an interconnected relation between the spaced walls and the bars in between.

2. A device as defined in claim 1 wherein the rail members have a substantially U-shaped cross-section.

3. A device as claimed in claim 1 wherein cam surfaces extend continuously over the length of the rail elements.

4. A device as claimed in claim 2 which includes a rail section adapted to serve as a handle on at least one of the rail elements, and means to fix the section to the rail element.

5. A railing device as claimed in claim 1 in which the openings in the base portion are of substantially rectangular shape and the cross-section of the bars are of similar shape and dimensioned to be slightly less to enable the bar to extend through the opening while militating against relative turning movement.

6. A railing device as claimed in claim 1 in which the rail members are retained in spaced interconnected relation between bars with the base members facing one another.

7. A railing device as claimed in claim 1 in which the cam surfaces comprise portions of increasing thickness in the side walls of the rail members to form an integral part thereof.

8. A railing device as claimed in claim 7 in which the openings in the base portion are other than round and the cross-section of the bars are of similar shape.

9. A railing device comprising a pair of elongate U-shaped rail members in spaced parallel relation, with the concavities of the U-shaped rail members facing in the opposite directions to provide inwardly facing bail portions with a plurality of longitudinally spaced openings therethrough and side walls extending outwardly in spaced substantially parallel relation from the lateral edges of the bail portions, ribs facing inwardly from the side walls, and a plurality of bars the opposite ends of which extend through aligned apertures in the bail portions of the rail members with the end portions of said bars being notched for resilient engagement with said ribs when the bars extend crosswise between the rail members in their assembled relation.

* * * * *